US010732570B2

(12) United States Patent
Peter et al.

(10) Patent No.: US 10,732,570 B2
(45) Date of Patent: Aug. 4, 2020

(54) STOPPING MECHANISM FOR TIMEPIECE STRIKING MECHANISM

(71) Applicant: Blancpain SA, Le Brassus (CH)

(72) Inventors: Julien Peter, Gollion (CH); Edmond Capt, Le Brassus (CH)

(73) Assignee: Blancpain SA, Le Brassus (CH)

( * ) Notice: Subject to any disclaimer, the term of this patent is extended or adjusted under 35 U.S.C. 154(b) by 231 days.

(21) Appl. No.: 16/020,288

(22) Filed: Jun. 27, 2018

(65) Prior Publication Data

US 2019/0033790 A1 Jan. 31, 2019

(30) Foreign Application Priority Data

Jul. 25, 2017 (EP) ..... 17182973

(51) Int. Cl.

| | |
|---|---|
| ***G04B 21/02*** | (2006.01) |
| ***G04B 13/00*** | (2006.01) |
| ***G04B 9/02*** | (2006.01) |
| ***G04B 23/12*** | (2006.01) |
| ***G04B 21/10*** | (2006.01) |

(Continued)

(52) U.S. Cl.

CPC ..... *G04B 13/00* (2013.01); *G04B 9/02* (2013.01); *G04B 19/02* (2013.01); *G04B 21/02* (2013.01); *G04B 21/10* (2013.01); *G04B 23/12* (2013.01); *G04B 21/14* (2013.01)

(58) Field of Classification Search

CPC ..... G04B 21/02; G04B 13/00; G04B 9/02; G04B 23/12; G04B 19/02; G04B 21/14

See application file for complete search history.

(56) References Cited

U.S. PATENT DOCUMENTS 1,160,065 A * 11/1915 Giset ..... G04B 21/022 368/270
2,851,850 A * 9/1958 Fowler ..... G04C 21/08 368/273

(Continued)

FOREIGN PATENT DOCUMENTS

| | | |
|---|---|---|
| CH | 704 672 A2 | 9/2012 |
| EP | 1 429 214 A1 | 6/2004 |
| EP | 2 226 688 A1 | 9/2010 |

OTHER PUBLICATIONS

European Search Report filed Feb. 16, 2018 in European Application 17182973.2 filed on Jul. 25, 2017 (with English Translation of Categories of Cited Documents).

*Primary Examiner* — Sean Kayes
(74) *Attorney, Agent, or Firm* — Oblon, McClelland, Maier & Neustadt, L.L.P.

(57) ABSTRACT

Stopping mechanism for a striking mechanism comprising energy storage means including a power reserve transmission wheel set, a strike wheel set comprising a detent ratchet, a main click for the passing strike function and/or a repeater release click, the stopping mechanism includes an uncoupling lever for moving the clicks away from the strike wheel set, by an instantaneous jump of a lever changing the position of the uncoupling lever, when the level of energy of the storage means crosses a predefined threshold, through the cooperation between a finger, driven by the power reserve transmission wheel set, and a jumper returned by a first spring, to bring the finger to bear on a fork of the lever to cause it to pivot abruptly by instantaneously changing the position of a lug with respect to a second spring.

10 Claims, 16 Drawing Sheets

(51) Int. Cl.
*G04B 19/02* (2006.01)
*G04B 21/14* (2006.01)

(56) References Cited

U.S. PATENT DOCUMENTS

| | | | | |
|---|---|---|---|---|
| 7,443,769 | B2 * | 10/2008 | Goeller | G04B 21/12 368/190 |
| 7,490,977 | B2 * | 2/2009 | Zaugg | G04B 9/00 368/210 |
| 7,782,717 | B2 * | 8/2010 | Gil | G04B 19/02 368/223 |
| 8,000,174 | B2 * | 8/2011 | Rochat | G04B 21/12 368/185 |
| 8,873,347 | B2 * | 10/2014 | Goeller | G04B 21/00 368/261 |
| 2008/0144449 | A1 * | 6/2008 | Goeller | G04B 21/12 368/190 |
| 2008/0225646 | A1 * | 9/2008 | Zaugg | G04B 9/00 368/66 |
| 2009/0067295 | A1 * | 3/2009 | Gil | G04B 19/02 368/69 |
| 2011/0310712 | A1 | 12/2011 | Papi et al. | |

* cited by examiner

STOPPING MECHANISM FOR TIMEPIECE STRIKING MECHANISM

This application claims priority from European Patent Application No. 17182973.2 filed on Jul. 25, 2017; the entire disclosure of which is incorporated herein by reference

FIELD OF THE INVENTION

The invention concerns a stopping mechanism for a striking mechanism for watches or timepieces comprising a movement, said striking mechanism and/or said movement including energy storage means arranged to power said striking mechanism for the striking functions, at an output comprising a power reserve transmission wheel set, said striking mechanism comprising at least one strike drive wheel set comprising a detent ratchet and a repeating rack pinion, a main click for the passing strike function and/or a click for releasing a minute repeater when said striking mechanism includes a minute repeater.

The invention also concerns a striking mechanism for watches or timepieces comprising a movement, said striking mechanism and/or said movement including energy storage means arranged to power said striking mechanism for the striking functions, at an output comprising a power reserve transmission wheel set, said striking mechanism including at least one strike drive wheel set comprising a detent ratchet and a repeating rack pinion, a main click for the passing strike function and/or a click for releasing the minute repeater when said striking mechanism includes a minute repeater.

The invention also concerns a watch comprising a movement including an output for releasing the passing strike function by the movement, this movement being arranged to drive at least one reference wheel set, and the watch includes at least one such striking mechanism.

The invention also concerns a timepiece comprising a movement including an output for releasing the passing strike function by the movement, this movement being arranged to drive at least one reference wheel set, and the timepiece includes at least one such striking mechanism.

The invention concerns the field of striking mechanisms for watches, timepieces or music boxes.

BACKGROUND OF THE INVENTION

Timepiece striking mechanisms are large, complex complications, as regards not only the number and complexity of the kinematics of their components, but also their possible operating modes. For watches that have additional complications, such as minute repeaters, managing the safety devices is very complex, and it is difficult to stop the passing strike function to allow a minute repeater to play, or conversely, to stop a minute repeater being released as a passing strike approaches, to prevent a minute repeater being released again when a repeater cycle has just started, to prevent an adjustment to the motion work during a striking function, etc., as these safety devices generally implement a large number of isolators, which further complicates the mechanism and the risk of interference.

EP Patent No 2503405B1 in the name of MONTRES BREGUET describes a timepiece including drive means, a movement, a power reserve control mechanism for the drive means, which includes an output arbor whose angular position indicates the power reserve available in the drive means, a striking mechanism controlled by a striking control mechanism, which includes a locking lever arranged to lock operation of the movement. This timepiece further includes, inserted between the output arbor and the locking lever, a selective stopping mechanism, for selectively stopping the striking functions of the timepiece, according to the available drive torque of the drive means, the selective stopping mechanism being arranged to manage the torque available in the drive means by limiting or not limiting operation of the striking functions, according to the angular position of the output arbor, to control a mechanism for releasing all or part of the available striking functions in the striking mechanism, via a transmission mechanism actuating an isolating wheel set comprised in the selective stopping mechanism and which is arranged to control the position of the locking lever and further arranged to release or prevent the movement of a strike control rod linkage and/or to allow or prevent a hammer striking a gong.

EP Patent Application No 2226688 A1 in the name of VAUCHER describes a timepiece which includes a control unit moved between defined positions by a power reserve mechanism. A release unit, i.e. a click wheel, is actuated to cooperate with a release beak to release an additional mechanism, for example an alarm mechanism. The release unit occupies positions in which the release unit respectively cooperates and does not cooperate with the beak. The control unit cooperates with the release unit and moves the release unit into one of the positions according to the corresponding position of the control unit.

EP Patent Application No 1429214 A1 in the name of ROTH & GENTA describes a timepiece provided with a mechanism striking the hours, and the quarters with a minute repeater, including a movable part of the striking mechanism capable of being moved between a determined rest position and an operating position, means for releasing the striking mechanism, means for periodically moving the movable part into the operating position when the striking mechanism is released, a hand-setting mechanism including a winding and setting stem on which a sliding pinion is slidably mounted to move into mesh with a setting train, a pull-out piece meshed, on the one hand, with the winding stem and, on the other hand, with a setting lever meshed with the sliding pinion. It includes means for locking the setting lever connecting the latter to the movable part of the striking mechanism, so that the locking means lock the setting lever as soon as the movable part of the striking mechanism is moved away from its rest position.

SUMMARY OF THE INVENTION

The invention proposes to achieve implementation of efficient safety devices of average complexity.

To this end, the invention concerns a stopping mechanism according to claim 1.

The invention also concerns a striking mechanism according to claim 8.

The invention further concerns a watch comprising a movement including an output for releasing a passing strike by the movement, this movement being arranged to drive at least one reference wheel set, and the watch includes at least one such striking mechanism.

The invention also concerns a timepiece comprising a movement including an output for releasing the passing strike function by the movement, this movement being arranged to drive at least one reference wheel set, and the timepiece includes at least one such striking mechanism.

BRIEF DESCRIPTION OF THE DRAWINGS

Other features and advantages of the invention will appear upon reading the following detailed description, with reference to the annexed drawings, in which:

FIGS. 1 and 2 represent the striking mechanism according to the invention in a petite sonnerie mode.

FIGS. 3 and 4 represent the striking mechanism according to the invention in a grande sonnerie mode.

FIGS. 5 and 6 represent the striking mechanism according to the invention in a silent mode.

FIGS. 7 and 8 represent the striking mechanism according to the invention with stopping in grande sonnerie mode.

FIG. 15 illustrates the starting position of this mechanism, with a stop finger comprised therein in an end position, at one end of the track of a stop spring.

FIG. 16 illustrates the start of the progression of the stop finger, with details in FIG. 17 of the jumper area and in FIG. 18 of the stop lever area.

FIG. 19 illustrates the continued progression of the stop finger.

FIG. 20 illustrates the stop finger reaching a tip-on-tip position with a stop jumper beak, with details in FIG. 21 of the jumper area and in FIG. 22 of the stop lever area.

Figure 23:
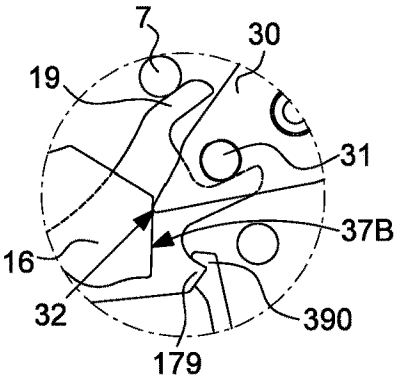

The following detailed Figures illustrate the continued progression of the stop finger:

FIG. 23 representing the jumper area and

Figure 24:
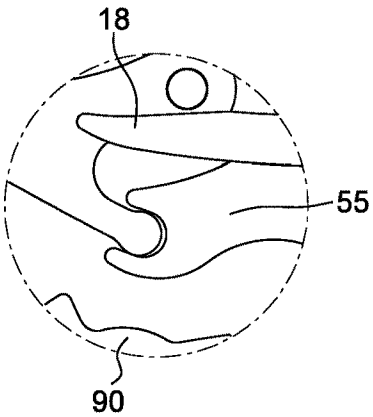
Figure 25:
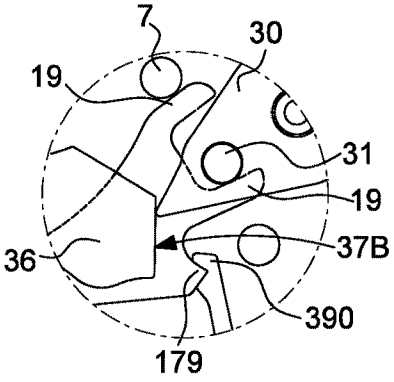
Figure 26:
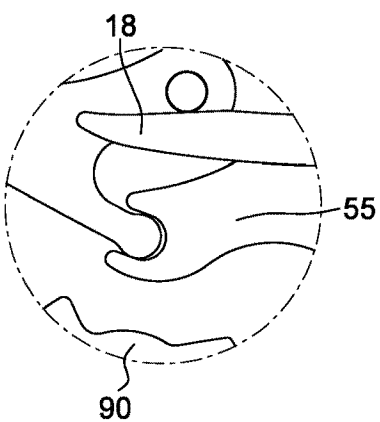
Figure 27:
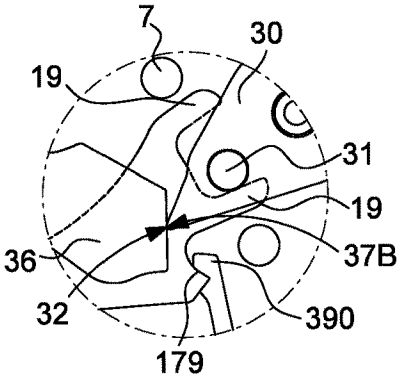
Figure 28:
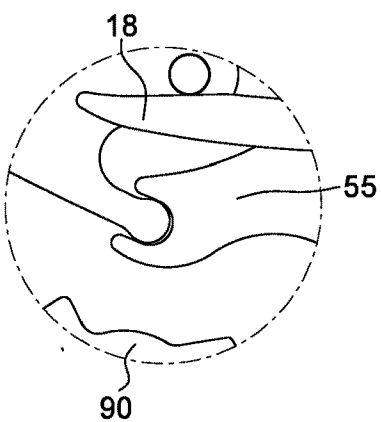

FIG. 24 the stop lever area when the stop pin of the stop finger is in contact with a fork of a repeating-slide control lever, then respectively in FIGS. 25 and 26 when the stop pin is in contact with the lever, then respectively in FIGS. 27 and 28 when a second spring is in tip-to-tip contact with a lug of the repeating-slide control lever.

Figure 29:
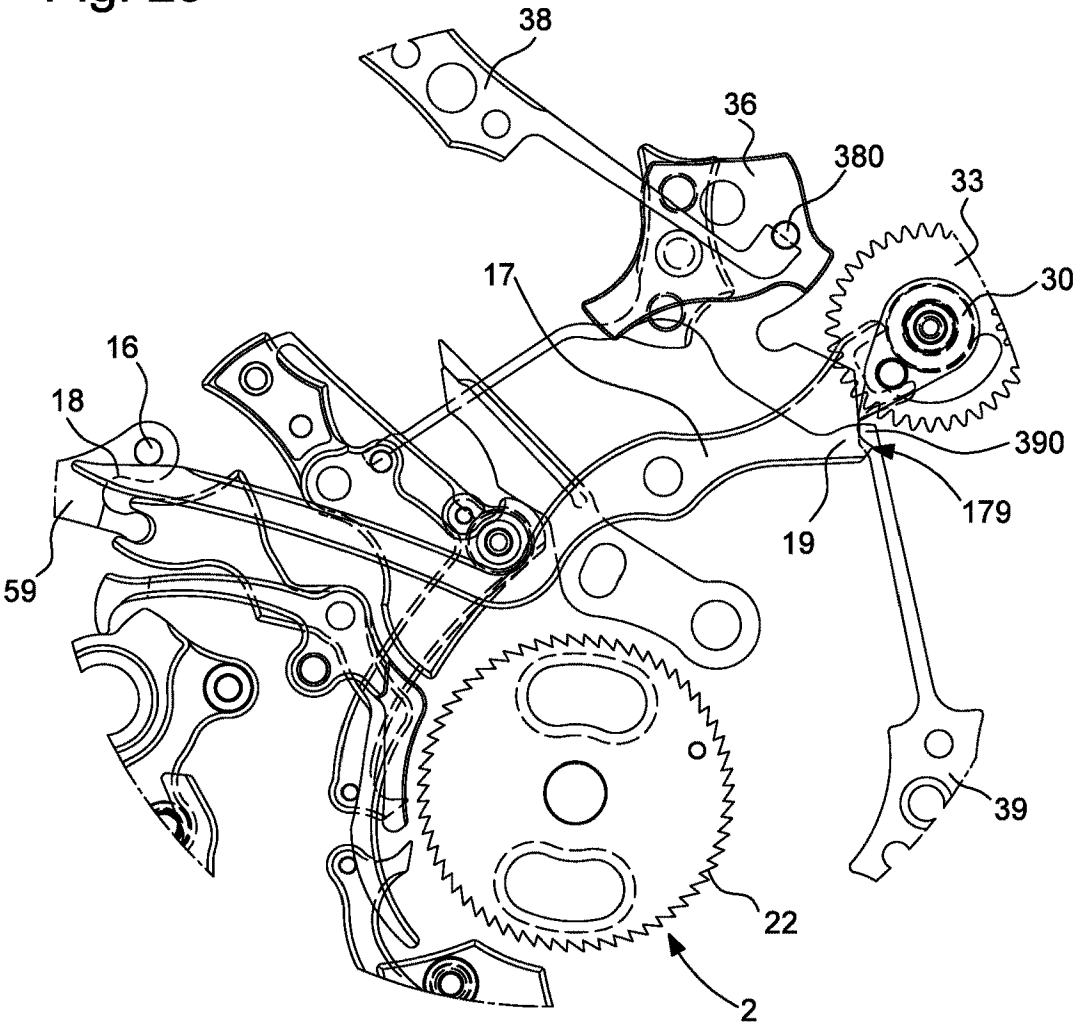
Figure 34:
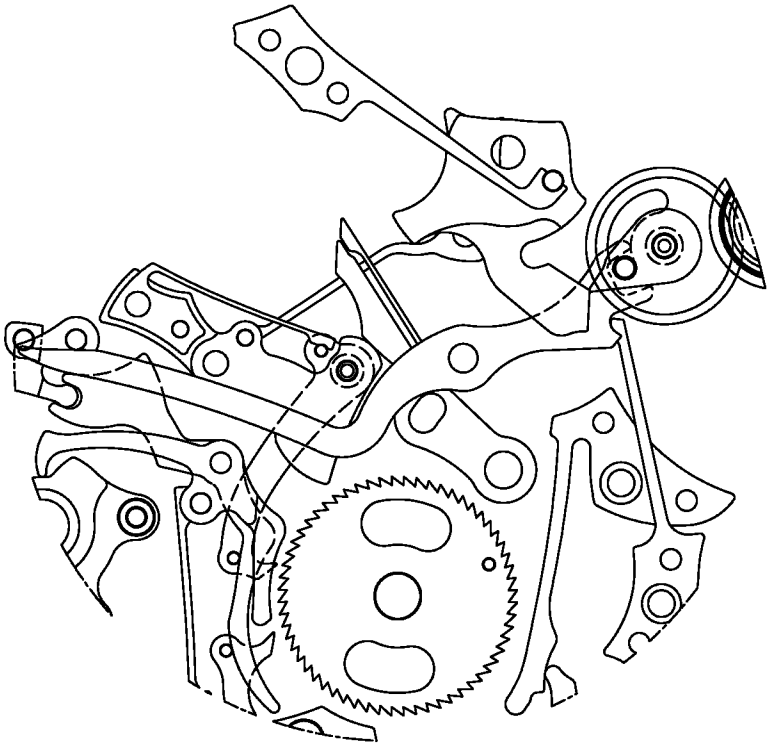
Figure 33:
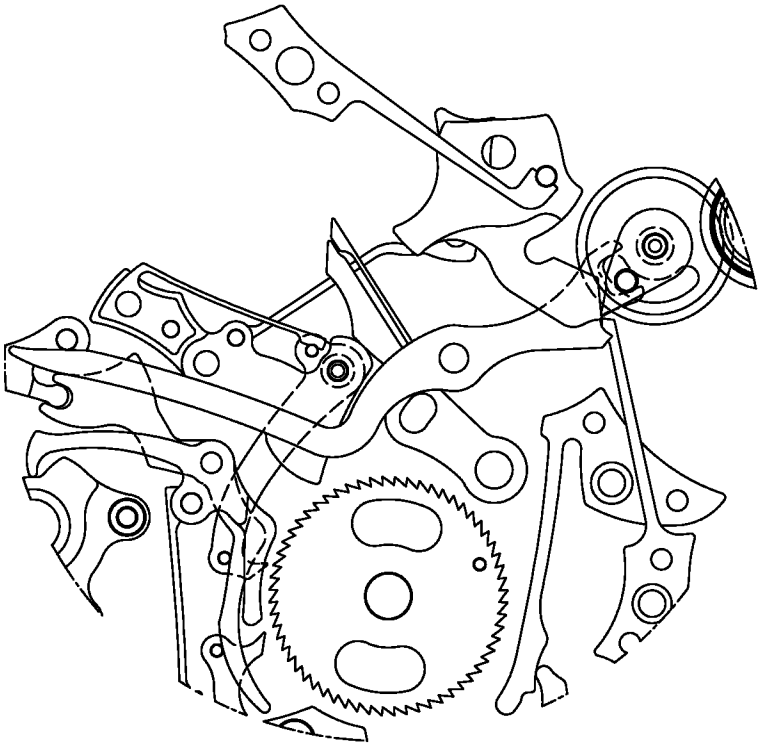
Figure 36:
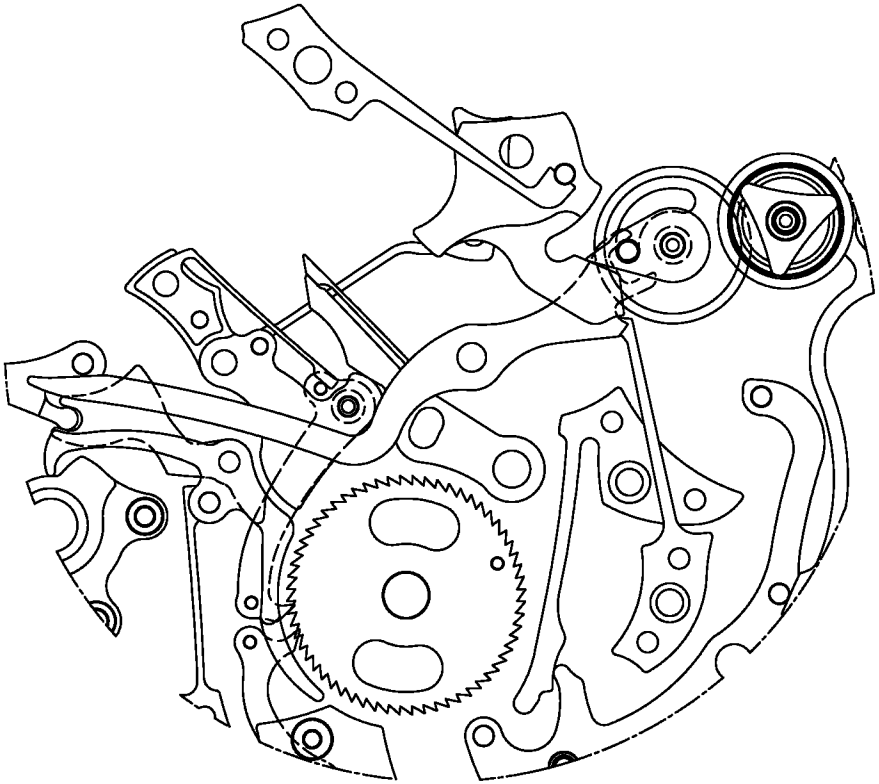
Figure 35:
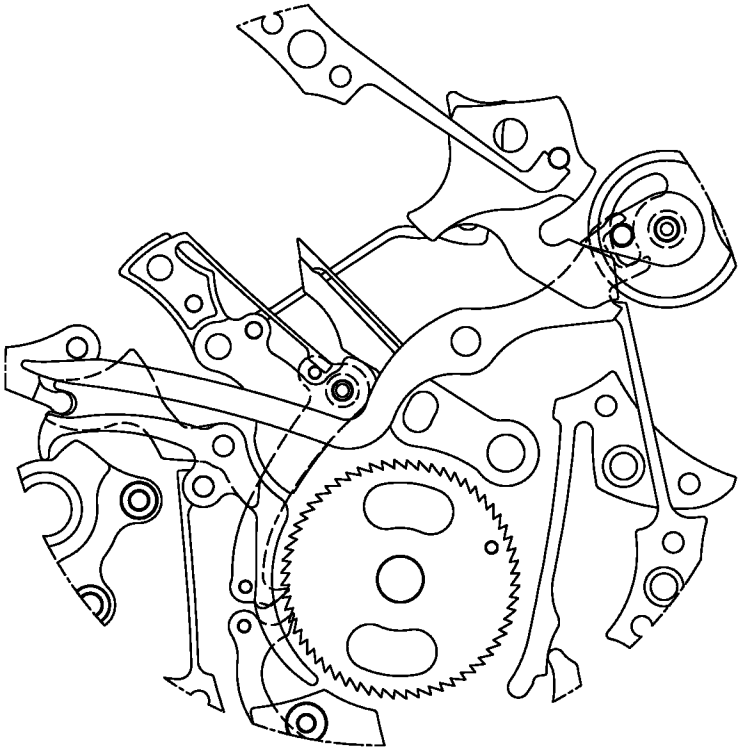

FIG. 29 illustrates the release of the stopping mechanism, with details in

Figure 30:
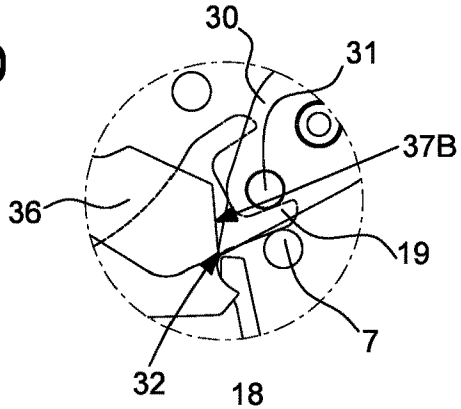

FIG. 30 of the jumper area and in

Figure 31:
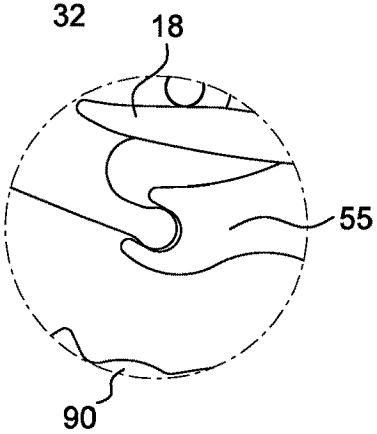

FIG. 31 of the stop lever area.

Figure 32:
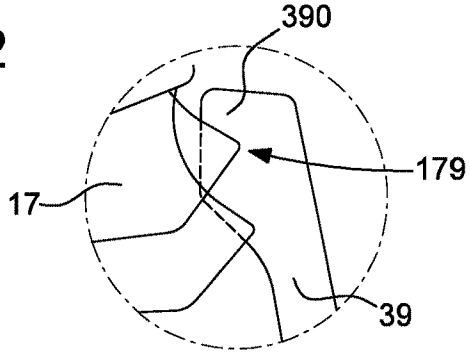

FIG. 32 is a detail of the area of cooperation between the tip of the second spring and the lug of of the repeating-slide control lever, this Figure shows the tip of the lever in its two positions.

FIGS. 33 to 36 illustrate, starting from the stopping position, the reverse manoeuvre showing operation when the strike barrel(s) are being wound.

Figure 37A:
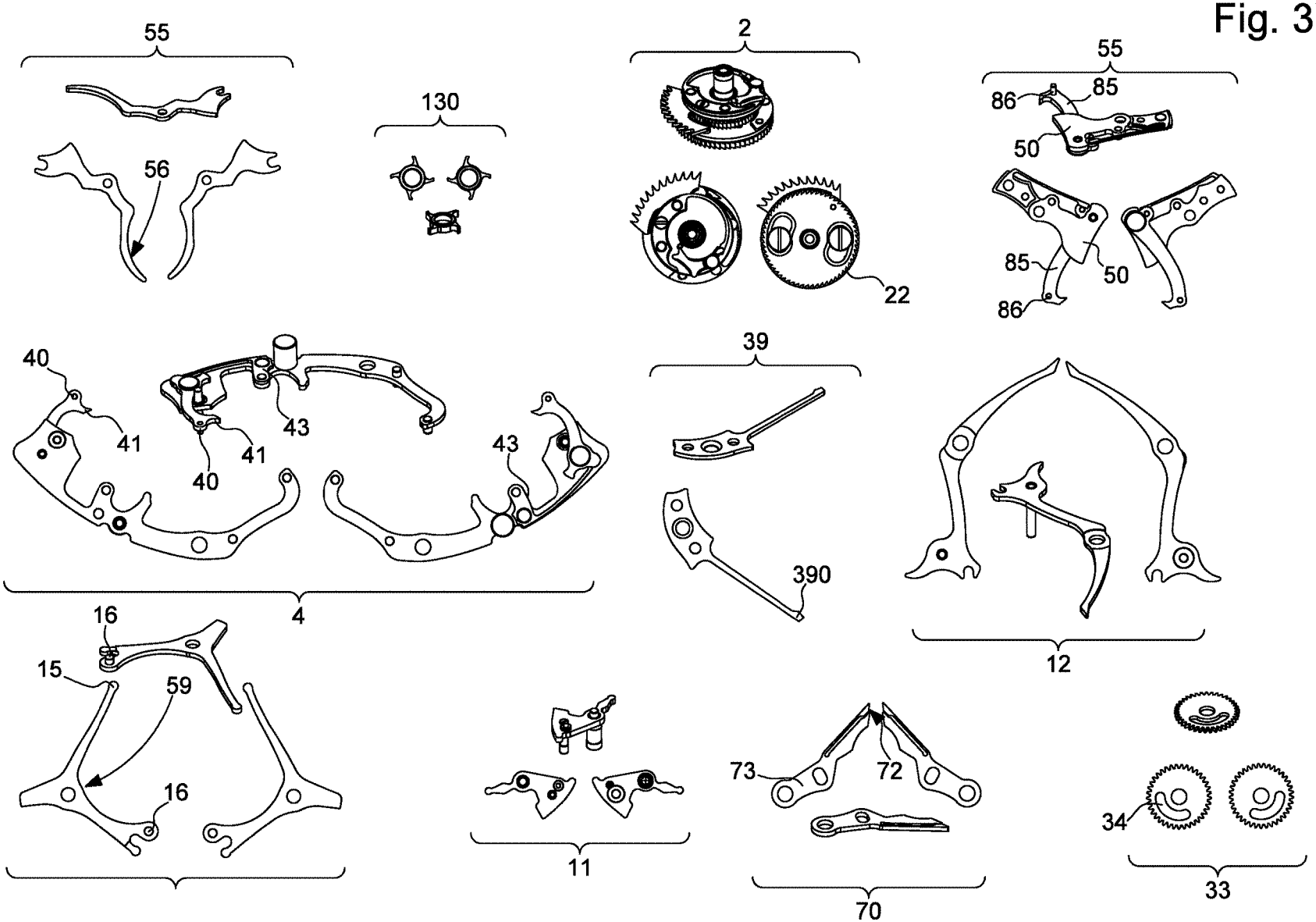
Figure 37B:
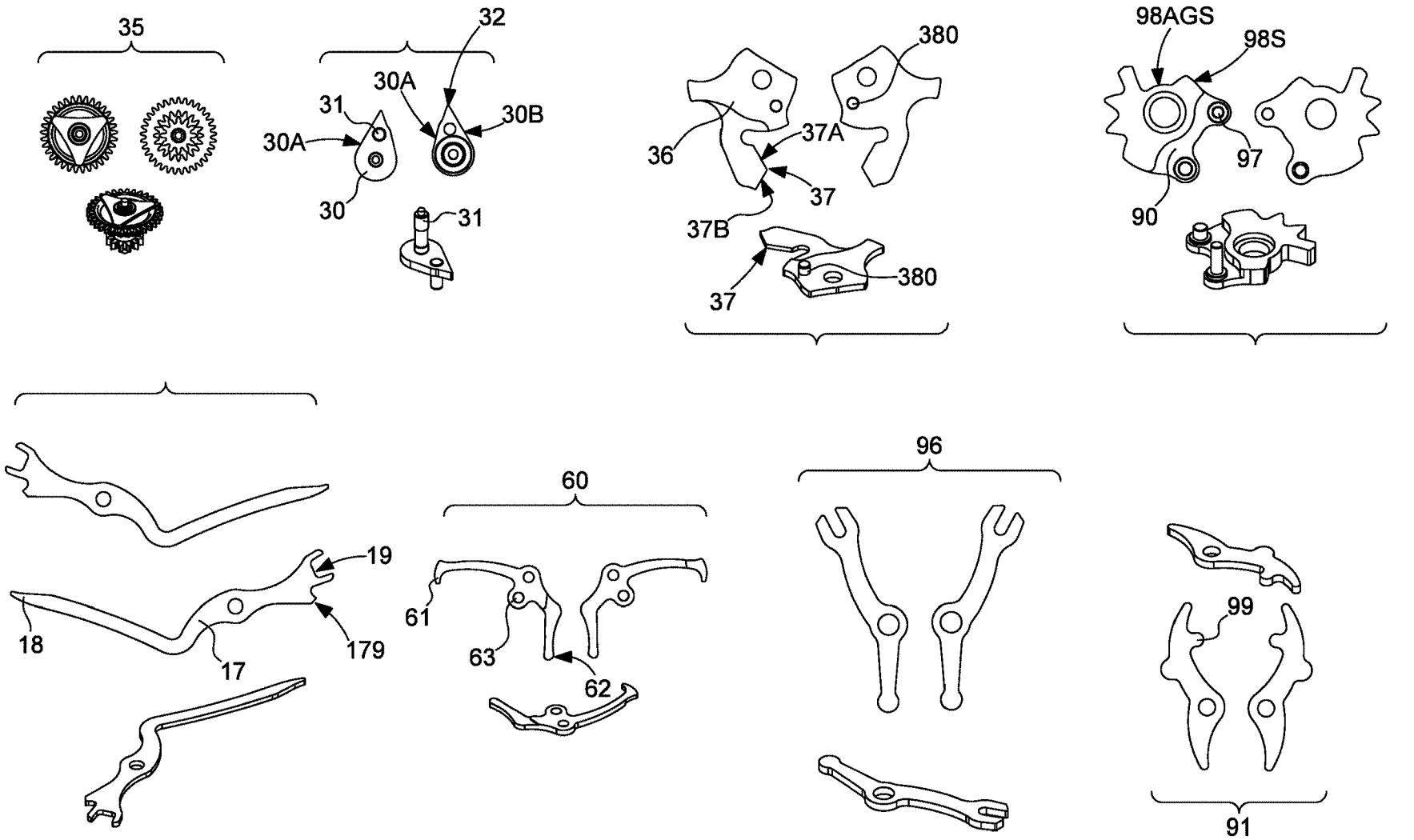

FIG. 37, which is divided into two plates 37A and 37B because of its format, is a schematic plan view of both sides of the panoply of main components of the stopping mechanism.

DETAILED DESCRIPTION OF PREFERRED EMBODIMENTS

The invention concerns a watch 1000 or a timepiece 2000 including at least one specific striking mechanism 100. This timepiece 2000 may be a music box or include a music box.

The work by François LECOULTRE entitled Les montres corn pliquées (A Guide to Complicated Watches), Editions Horlogères, Bienne (Switzerland), 1985, ISBN 2-88175-000-1, explains, in detail, the basic mechanisms forming striking mechanisms, at pages 85 to 181 (English edition), in different chapters:

repeating watches,
old repeating watches,
modern quarter-repeater,
simplified repeater,
half-quarter repeater,
Breguet half-quarter repeater,
five minute-repeater,
minute-repeaters
clock watches Unless necessary, these basic mechanisms will not be discussed here in detail, since striking mechanism specialists will know how to find the composition thereof in this universal reference work, in particular in the aforementioned last two chapters.

Striking mechanism 100 according to the invention includes, in a conventional manner, at least one reference wheel set 1, and preferably a plurality of reference wheel sets 1, including time reference snails and/or stars, and particularly a minute snail, a quarter snail and an hour snail 190.

This striking mechanism 100 also includes at least one strike drive wheel set 2, as explained in particular in the chapter on 'Clock Watches' in 'A Guide to Complicated Watches' and visible, in particular, in FIG. 40 of this book. This drive wheel set 2 conventionally includes a detent ratchet 22 and a repeating rack pinion 24.

Striking mechanism 100 cooperates with a movement 200, which drives the reference wheel set(s) 1, and a specific output 3 of which is illustrated in the Figures, in the non-limiting form of a star 130 for releasing the strike by the movement, fitted onto a cannon-pinion, and including four teeth, in order to lift, at each quarter hour, an intermediate lever for release by the movement, referred to hereinafter as gathering pallet 70.

Striking mechanism 100 includes at least one pivoting part, which is arranged to cooperate indirectly, via this gathering pallet 70, with the output 3 of movement 200, and particularly includes a feeler for reading such a reference wheel set 1 and a rack driving repeating rack pinion 24. One of these pivoting parts is an hour-rack 20 arranged to cooperate with the hour-snail 190. Striking mechanism 100 further includes a main click 85, which is arranged to be set in motion upon each passing strike, and to drive, when possible, detent ratchet 22.

Striking mechanism 100 according to the invention includes all or part of the main strike modes: grande sonnerie, petite sonnerie, alarm, silent, and more particularly includes a minute repeater mechanism, particularly a minute repeater mechanism, notably as explained in the 'Minute Repeater' chapter of 'A Guide to complicated watches Les montres cornpliquées'.

The non-limiting variant illustrated by the Figures includes three striking modes: grande sonnerie (GS), petite sonnerie (PS), silent (S), and a minute repeater. This minute repeater mechanism includes, in particular, an hour-rack 20, arranged to cooperate, with a feeler 29 comprised therein, with an hour-snail 190.

Deactivating the striking mechanism in silent mode moves the clicks away from strike drive wheel set 2 and prevents access by the hour-rack to the corresponding snail.

In particular, striking mechanism 100 includes a minute repeater with a minute repeater control device 4 including a repeater click 40, which is arranged to drive detent ratchet 22 once said hour-rack 20 has performed a reading on hour-snail 190. And, in silent mode, the main arm 64 of silencing lever 60 allows repeater click 40 access to detent ratchet 22, provided the energy available is sufficient to complete a striking function.

In a particular embodiment, striking mechanism 100 includes a grande sonnerie mode for the passing strike of each hour and of each quarter hour, repeating the hour at the quarter hour, and a petite sonnerie mode for the passing strike of each hour and of each quarter hour without repeating the hour at the quarter hour. Striking mechanism 100 thus includes a petite sonnerie lever 80, which is arranged, when the petite sonnerie mode is selected, to orient the petite sonnerie lever 80 into a position in which the latter prevents hour-rack 20 moving towards hour-snail 190, to prevent the hour being struck at the quarter hours.

When, in this same arrangement, the grande sonnerie mode is selected, the petite sonnerie lever 80 is oriented into another position in which the latter allows hour-rack 20 to move towards hour-snail 190, to allow the hours to be struck automatically at the quarter hours.

To distinguish between the passing strike of the hours and the quarter hours, striking mechanism 100 advantageously comprises, coaxial to a four-tooth star 130 driven by output 3 and which is arranged to automatically release strikes on the quarter hours, a tear-shaped hour cam 131, comprising a tip 132 which is arranged to lift petite sonnerie lever 80 and to allow hour-rack 20 to move towards hour-snail 190.

The selection of a specific striking mode does not hinder the operation of the minute repeater, and particularly in silent mode, except when, advantageously, striking mechanism 100 includes a particular stopping function arranged to prevent any striking function being performed if the amount of energy available is insufficient to ensure that the striking function is completed: striking mechanism 100 then advantageously comprises a stopping mechanism 5, which is arranged to prevent any striking function being performed, in order to avoid the risk caused by certain wheel sets stopping in intermediate positions, which is liable to cause collisions on restarting. It is only in the case where the stopping function is efficient that operation of the minute repeater is also prohibited.

This stopping mechanism 5 is arranged to pivot a strike reversing lever 59, particularly when the available energy is insufficient to complete a striking function. This strike reversing lever 59 controls the pivoting of a strike uncoupling lever 55, which is arranged to prevent access by repeater click 40 to detent ratchet 22 when the available energy is insufficient to complete a striking function, and to move main click 85 away from detent ratchet 22 when the available energy is insufficient to complete a striking function.

Unlike a minute repeater, which is controlled and powered instantaneously by the action of a user on a pull-out piece, a push-piece, or suchlike, the grande sonnerie mechanism is powered by an energy reserve, particularly at least one barrel, inside the watch. Different energy storage configurations are possible, according to the space available inside the watch: a single barrel powering both the movement and the striking mechanisms, or one barrel dedicated to the movement and one or more barrels dedicated to the striking mechanisms, which always have high energy consumption. The storage device is not detailed here, the drawings show a strike power reserve indicator output wheel 35, which forms the output of a differential mechanism, and referred to hereinafter more simply as power reserve transmission wheel set 35, known to those skilled in the art. More particularly, this power reserve transmission wheel set 35 includes several coaxial wheels and pinions, assembled by friction.

This power reserve transmission wheel set 35 meshes with a stop wheel 33, which includes an oblong hole 34. A stop finger 30 is mounted coaxially to stop wheel 33, and this finger 30 includes a stop pin 31, which is movable in a limited manner inside oblong hole 34, and a tip 32.

A stop jumper 36 is positioned facing this stop finger 30, it is returned by a first spring 38, in the anticlockwise direction in the Figures. In another variant, the stop jumper 36 can be in one piece with this spring 38.

Tip 32 of stop finger 30 is arranged to follow an edge of stop spring 36. In particular, in the variant of the Figures, this stop jumper 36 includes, on this edge, a beak 37, surrounded by a first surface 37A and a second surface 37B, which are substantially plane here, and which are not aligned (in the non-limiting example of the Figures they form an angle of around 120° between them): the travel of tip 32 thus includes, regardless of the direction of travel, an ascending slope against the torque of a spring, passage over beak 37, and a descending slope after beak 37.

Stopping mechanism 5 also includes a repeating-slide control lever 17, which is arranged to control a change of position of strike uncoupling lever 55, when repeating-slide control lever 17 jumps instantaneously once the level of available energy in said storage means crosses a predefined threshold: in a first direction to uncouple the striking mechanism, when the energy in the storage means is lower than this threshold, or conversely, in the opposite direction, to allow a striking mechanism to operate again, when the energy in the storage means is once again higher than this predefined threshold.

This repeating-slide control lever 17 includes, at a first end, a fork 19 arranged to surround stop pin 31 and, underneath fork 19, a lug 179, which is arranged to cooperate with a second spring 39, or with a jumper controlled by second spring 39, which gives repeating-slide control lever 17 bistable behaviour, as will be seen below in the explanation of operation. Naturally, second uncoupling spring 39 may, in a variant, be made in one piece with repeating-slide control lever 17.

Repeating-slide control lever 17 includes, at a second, opposite end, a control arm 18. This control arm 18 rests on a pin 16 comprised in strike reversing lever 59, which is itself articulated on a first side to strike uncoupling lever 55.

Strike reversing lever 59 is articulated on a second side with an uncoupling lever 12, returned by an uncoupling spring 13, and cooperating with a pull-out piece 11 cooperating in a conventional manner with winding and setting control stem 10 of the watch. Naturally, uncoupling spring 13 may, in a variant, be made in one piece with uncoupling lever 12. Uncoupling lever 12 advantageously carries an indicator 14, such as a plate seen through an aperture as shown in FIG. 15, or such as a hand facing pictograms or the like, or any other suitable display system, intended to inform the user in a very simple manner as to whether or not the striking mechanisms are available.

FIGS. 15 to 32 explain the kinematics of stopping mechanism 5, which operates in a reversible manner, with FIGS. 33 to 36 illustrating the reverse manoeuvre.

Figure 15:
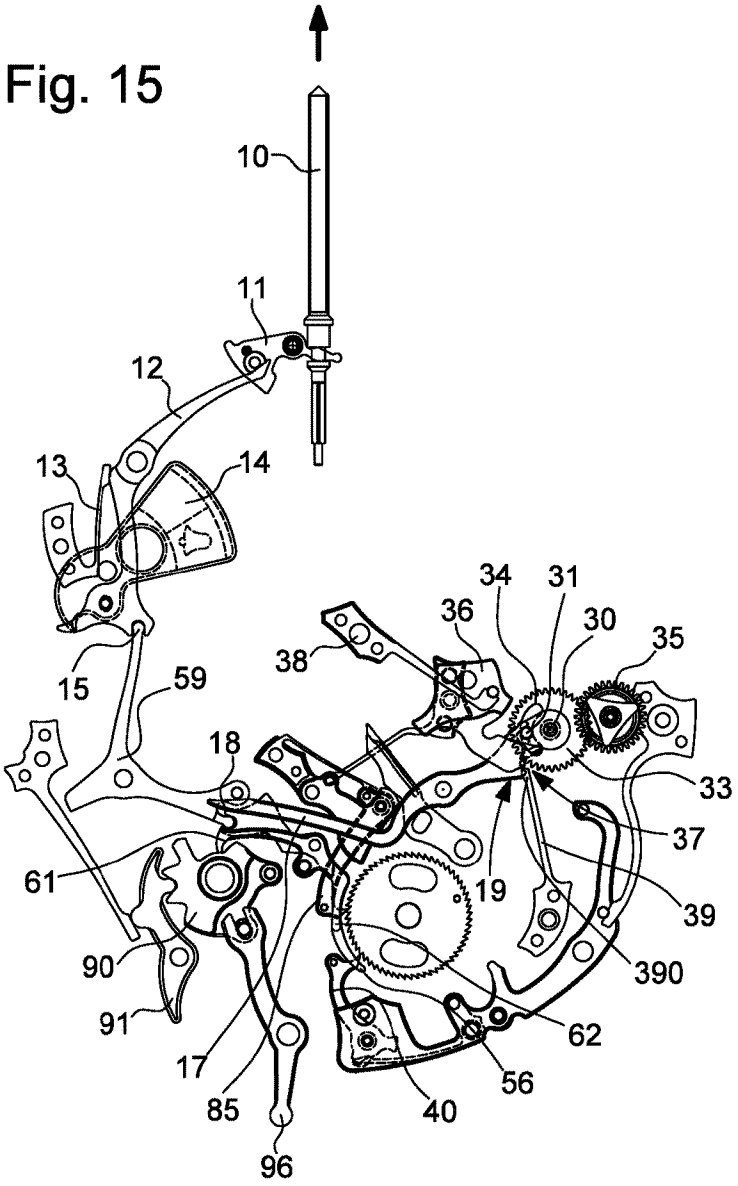
Figure 19:
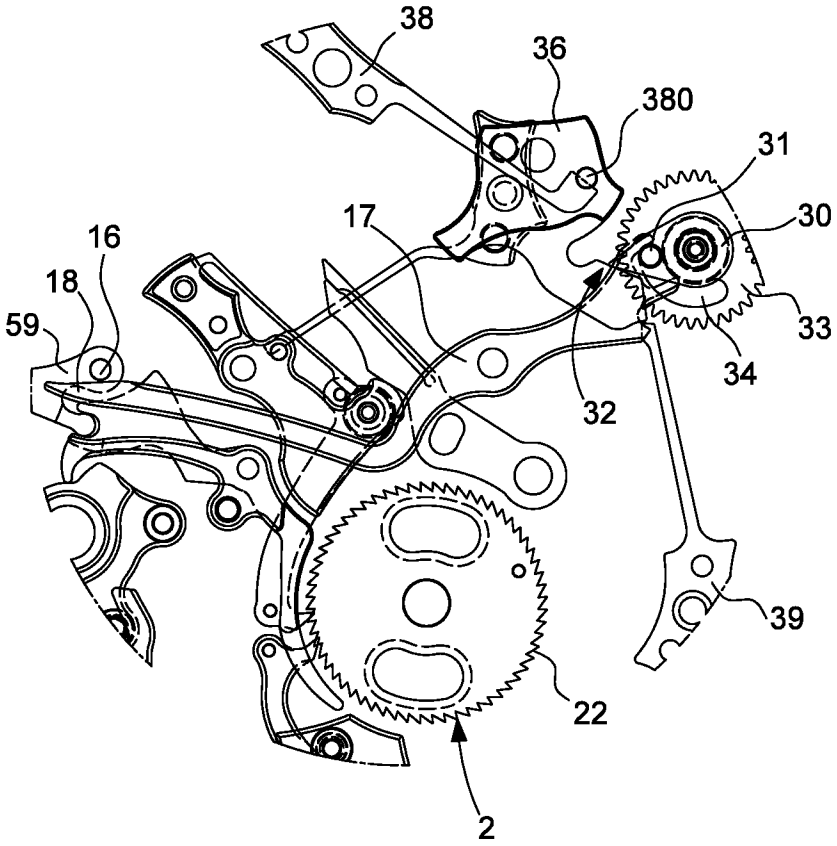
Figure 21:
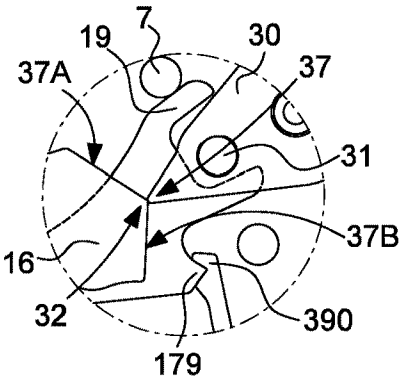
Figure 22:
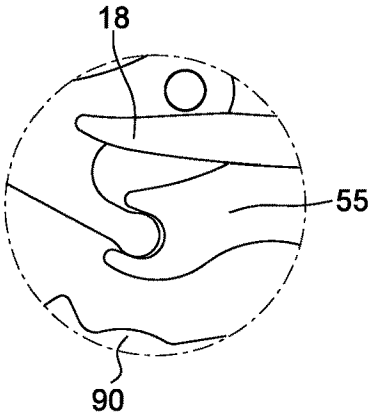

From the initial position of FIG. 15, power reserve transmission wheel set 35 drives stop wheel 33, until, as seen in FIG. 19, oblong hole 34 comes into contact with stop pin 31, thus pivoting stop finger 30, which is in contact, via its tip 32, with first surface 37A of stop jumper 36, which is close to one of its flanks 30A. Stop finger 30, thus indirectly driven by power reserve transmission wheel set 35, must overcome the ascending slope represented by this first surface 37A and the torque imparted by first spring 38.

Figure 20:
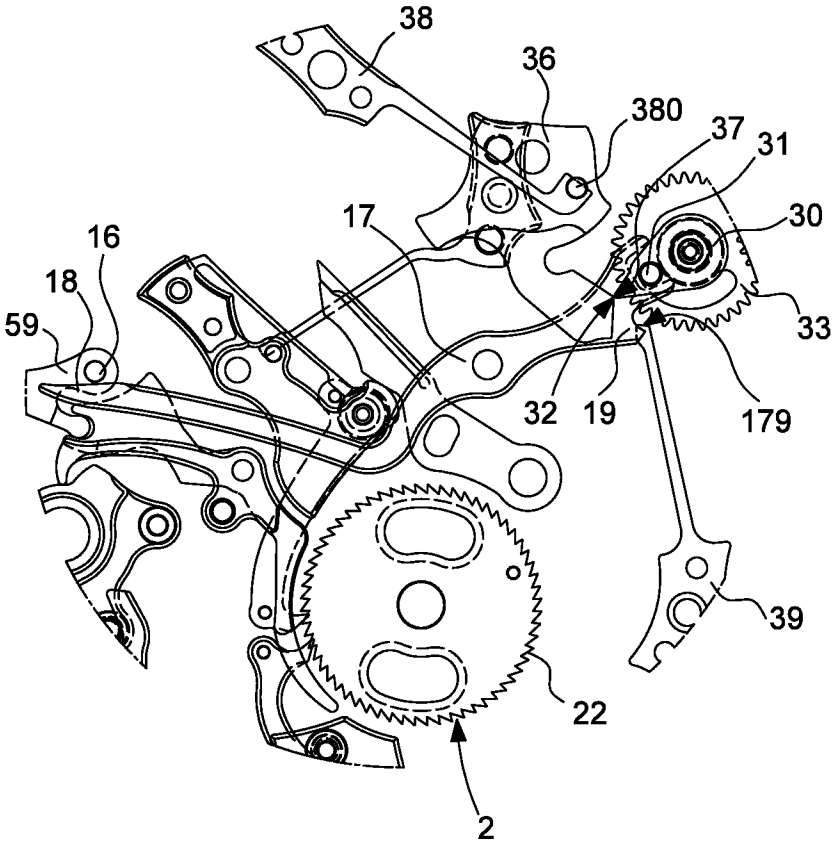

After having covered an angle of around 20°, tip 32 of stop finger 30 reaches the top 37 of the slope of first surface 37A of stop jumper 36, as seen in FIG. 20. At this stage, stop pin 31 is not yet in contact with the edge of fork 19 of repeating-slide control lever 17.

The cooperation of stop finger 30 and stop jumper 36 allows stop pin 31 to be brought to bear on fork 19, in order to abruptly pivot repeating-slide control lever 17 by the instantaneous change of position of a lug 179 comprised in said lever 17 with respect to a second spring 39: as soon as tip 32 of stop finger 30 has passed top 37 and comes into contact with second surface 37B of stop jumper 36, stop pin 31 comes into contact with the edge of fork 19. Second spring 39 includes a tip 390 which moves from one side to the other of lug 179 of repeating-slide control lever 17, whose second spring 39 thus causes the reversal.

This second spring 39 thus forms a repeating-slide control jumper, which is arranged to force fork 19 of repeating-slide control lever 17 to rest against a detent pin 7, preferably one on each side of fork 19, or on a banking wall, in each of the two positions that repeating-slide control lever 17 can occupy, thereby giving said lever its bistable nature.

Stop finger 30 travels another approximately 20° before reaching the final stop position of FIG. 29, wherein stop pin 31 is resting on the other end of fork 19, the second flank 30B of stop finger 30 being in contact with second surface 37B of stop jumper 36. In this final position, fork 19 is resting against detent pin 7.

The release thus achieved is instantaneous and provides complete security.

The function operates in both directions of operation.

The invention makes it possible to achieve stopping in grande sonnerie mode when the stopping function and the grande sonnerie mode exist. The same applies to the petite sonnerie mode and the silent mode.

This striking mechanism 100 is first displayed without the stopping mechanism.

Figure 2:
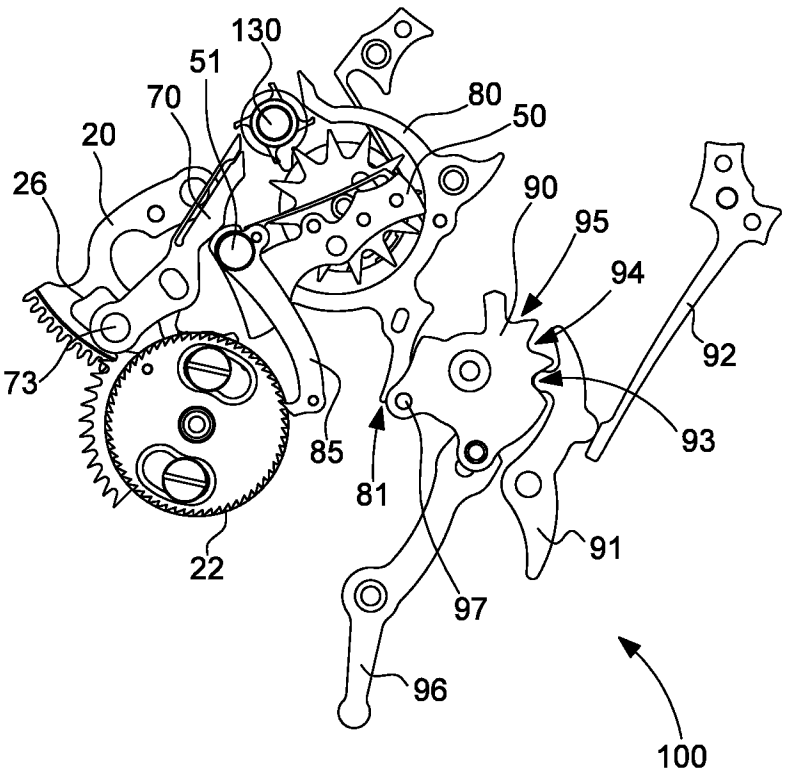
FIGS. 1 to 8 schematically represent, two-by-two and in a plan view, the striking mechanism according to the invention in the same position, the odd Figures showing the back side, and the even Figures showing the front side; not all the components are represented, only those which are essential for performing the illustrated function are visible.
Figure 1:
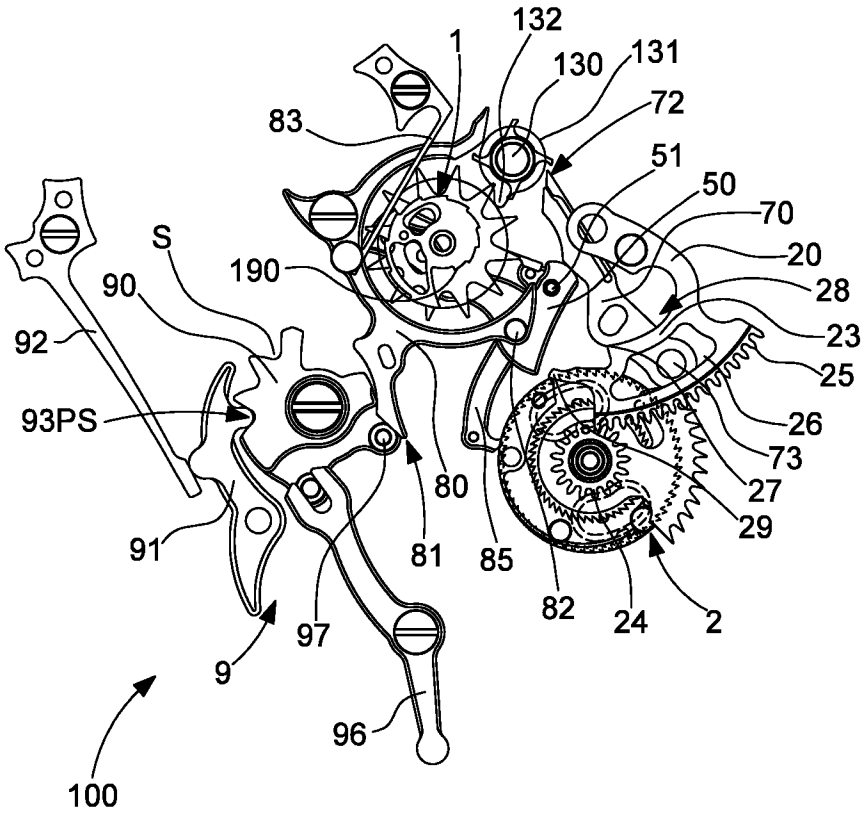

FIGS. 1 and 2 show the petite sonnerie position, which strikes the full hours on passing, and the quarter hours only on passing. The usual quarter-rack and quarter-snail are not represented, in order to simplify the explanation of operation.

Star-wheel 130, arranged in proximity to reference wheel sets 1, is arranged to move into cooperation, every quarter hour, with a beak 72, especially an elastic beak, comprised in strike release gathering pallet 70, which pivots in a pivot 73.

This quarter-rack 20 includes a feeler 29 arranged to feel an hour-snail 190, and a rack 25 arranged to cooperate with a repeating rack pinion 24 comprised in a strike drive wheel set 2. Hour-rack 20 further includes, set back with respect to feeler 29, a rib 23 separating oblong hole 26 from an inner recess 28, and rib 23 ends, on the same side as feeler 29, in a flat abutment portion 27.

Strike drive wheel set 2 includes, in a conventional manner, a detent ratchet 22, which is arranged to cooperate, either with a main strike click 85, or a minute repeater release click 40, provided with a pin 41, and comprised in a minute repeater control device 4, wherein this latter click 40 cooperates with a spring 43.

The pivoting of strike release gathering pallet 70 causes the pivoting of a lever 50 for release by the movement, which carries a thrust spring 52, which rests on main strike click 85, which is also carried by release lever 50.

A conventional petite sonnerie lever 80 carries a banking pin 82. This petite sonnerie lever 80, which is returned by an uncoupling spring 83 fixed to a plate, includes an uncoupling beak 81, which is arranged to rest on a cam pin 97 comprised in a mode selector cam 90, comprised in a mode selector mechanism 9.

Petite sonnerie lever 80 faces hour-rack 20 during the angular travel of the latter, and banking pin 82 is at the level of rib 23 of hour-rack 20, on the same radius, which allows it to cooperate in abutment with flat portion 27 of hour-rack 20, and to immobilise the latter by preventing it from reaching hour-snail 190, so that the hour strike is not repeated at each quarter hour, in accordance with the operation specific to the petite sonnerie mode.

In order to ensure that the hour is struck on the full hour, star-wheel 130 is integral with a tear-shaped hour cam 131, whose tip 132 is arranged to lift the petite sonnerie lever 80, and thus its banking pin 82, to allow feeler 29 of hour-rack 20 to pass and read hour-snail 190.

Figure 4:
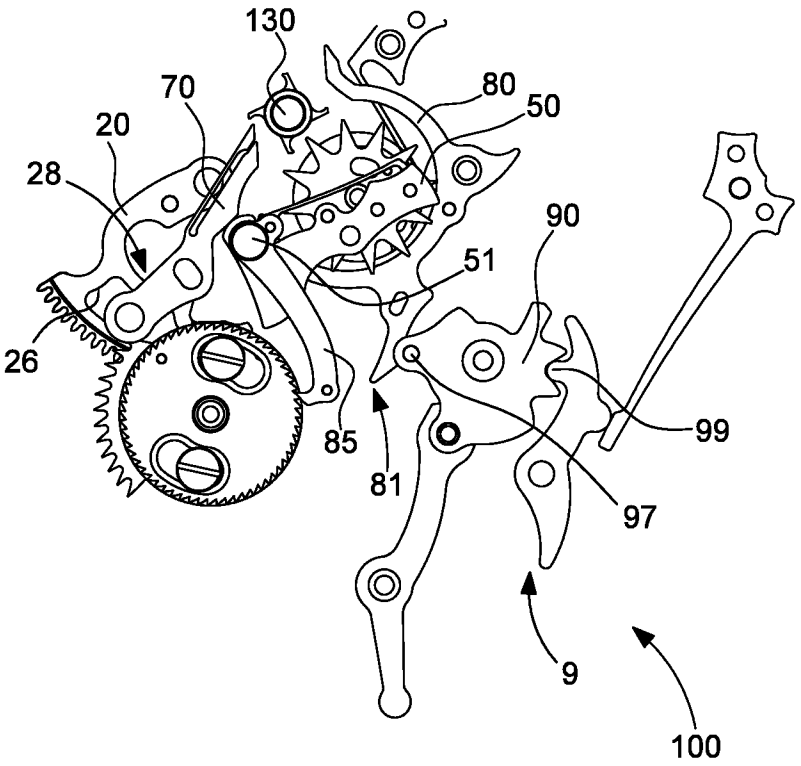
Figure 3:
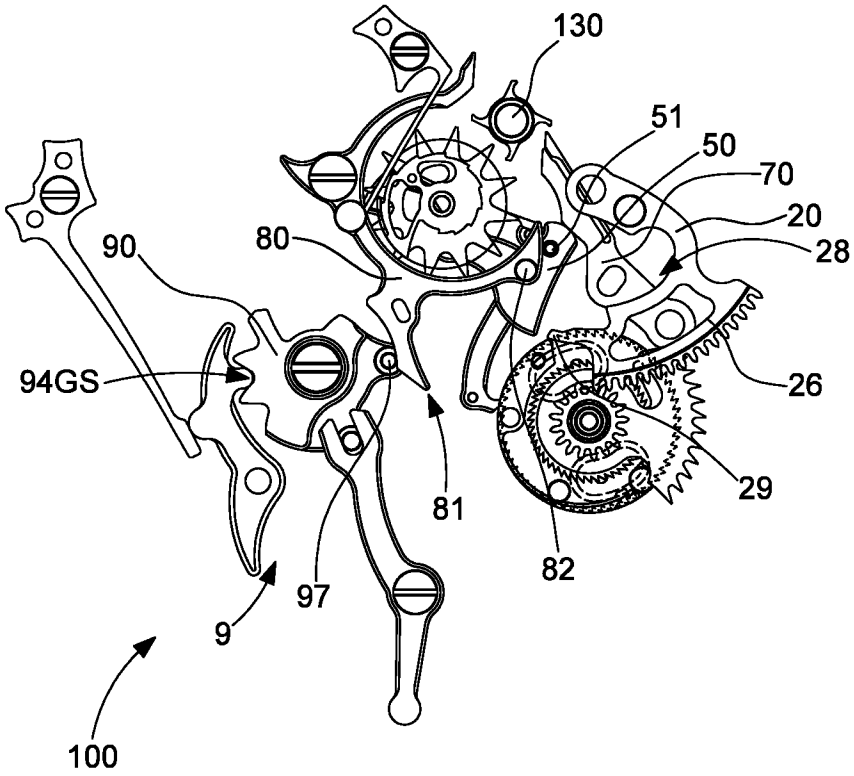

FIGS. 3 and 4 show the grande sonnerie position, which strikes the full hours on passing, and repeats the hour and strikes the quarter-hours on passing. The usual quarter-rack and quarter-snail are not represented. Cam pin 97 bears on petite sonnerie lever 80 at a greater distance from the end of uncoupling beak 81 than in the case of the petite sonnerie, and consequently banking pin 82 is no longer at the level of rib 23, or of flat portion 27 of hour-rack 20, but is at the level of recess 28, which allows hour-rack 20 to pivot freely towards hour-snail 190 at every quarter hour.

For operation in silent mode, striking mechanism 100 includes a grande sonnerie and petite sonnerie isolator, hereinafter referred to as silencing lever 60. This silencing lever 60 includes, at a first end, a reading beak 61 arranged to cooperate with one of the peripheral areas 98 of mode selection cam 90, and at a second end 62, a main arm 64, which is arranged to stop a main click pin 86, comprised in main strike click 85. This silencing lever 60 includes, in its median part in proximity to its pivot, a silencing pin 63.

Spring 65 constrains silencing lever 60 via pin 63, so that the lever is always in contact with cam 90 via its beak 61. When the selected mode is silent mode, this silencing lever 60 pivots and its part 62 moves to disconnect click 85 from ratchet 22. Cam pin 97 is in contact with uncoupling beak 81 of petite sonnerie lever 80. During a minute repeater function (in petite sonnerie mode), a lever (not represented in the Figures) forms the link between control device 4 and the hole in lever 80, so that hour-rack 20 can fall onto hour-snail 190 of component 1.

Silencing lever 60 is seen in FIGS. 5 to 11, which include stopping mechanism 5, which essentially comprises a strike uncoupling lever 55. Striking mechanism 100 thus includes silencing lever 60 and strike uncoupling lever 55, which are partially superposed, and each arranged to hinder access by a specific click to ratchet 22 of strike drive wheel set 2. Indeed, strike uncoupling lever 55 includes a stop arm 56, which is arranged to stop a repeater click pin 41, comprised in a minute repeater release click 40, of minute repeater control device 4.

The Figures show the particular arrangement of main click 85 and of minute repeater release click 40, which are both located on the same side of strike drive wheel set 2 and its ratchet 22, between mode selection cam 90 and ratchet 22. This arrangement is particularly advantageous, due to its particularly reduced volume and the short distances between the various components, which means that stiffer levers can be used, and it allows for the design of a stopping mechanism which is both compact, reliable and efficient. This arrangement is made possible, in particular, by the insertion of release lever 50 between gathering pallet 70 or first strike release lever, and main click 85: this release lever 50 supports the articulation of main click 85, and includes spring 52 which pushes on the click; it allows main click 85 to be positioned on the same side as minute repeater release click 40 with respect to ratchet 22, it reverses the direction of pivoting of main click 85 compared to a standard assembly in which the latter is meshed directly in gathering pallet 70, and, in particular, allows energy to be saved by precisely managing the engagement and disengagement of main click 85 with respect to ratchet 22. More particularly, main click 85 and minute repeater release click 40 are substantially aligned as a result of this novel arrangement, and silencing lever 60 and strike uncoupling lever 55 can be superposed, in an almost collinear manner, which considerably simplifies the control and stopping of the striking functions, by reducing the number of components and the manoeuvring travels of these components.

Figure 6:
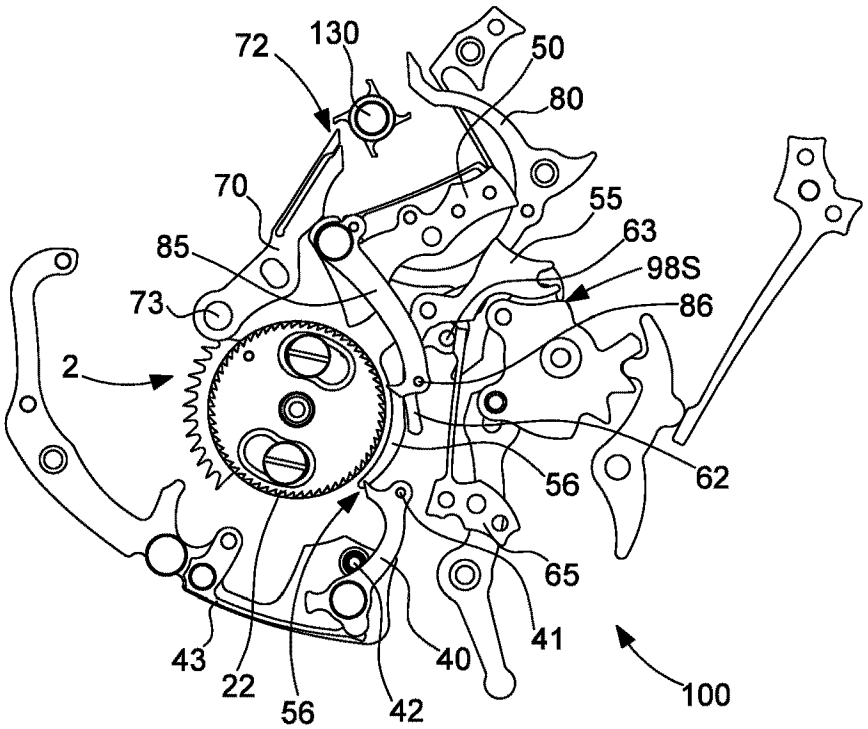
Figure 5:
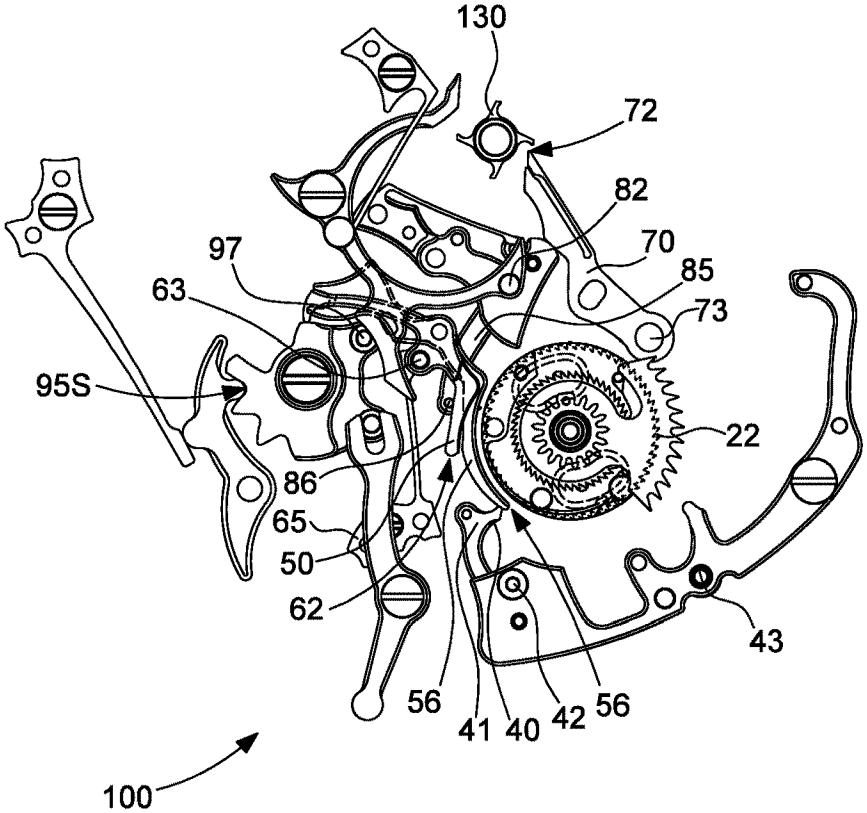
Figure 11:
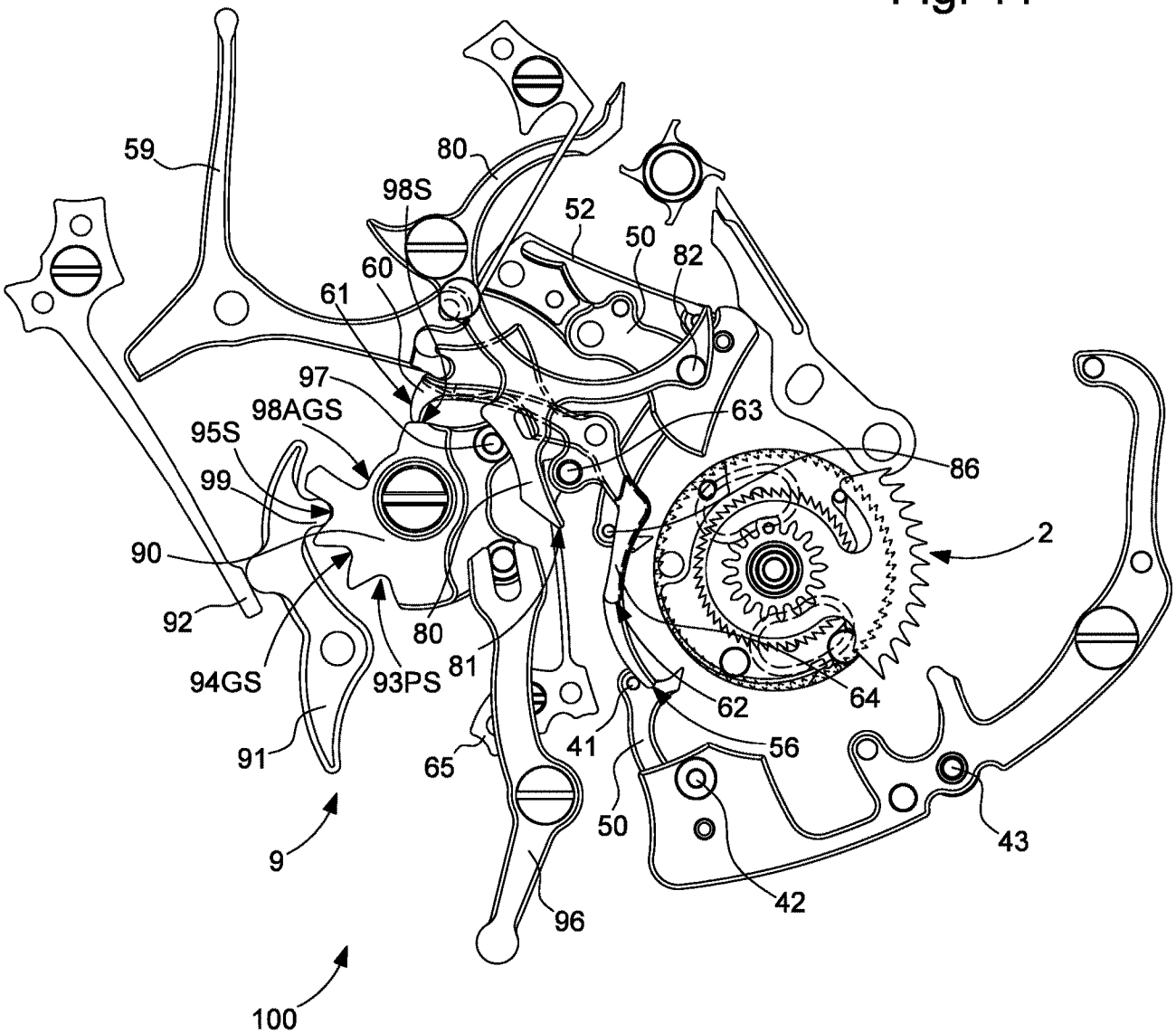
FIG. 11 is a detail of FIG. 9.
Figure 12:
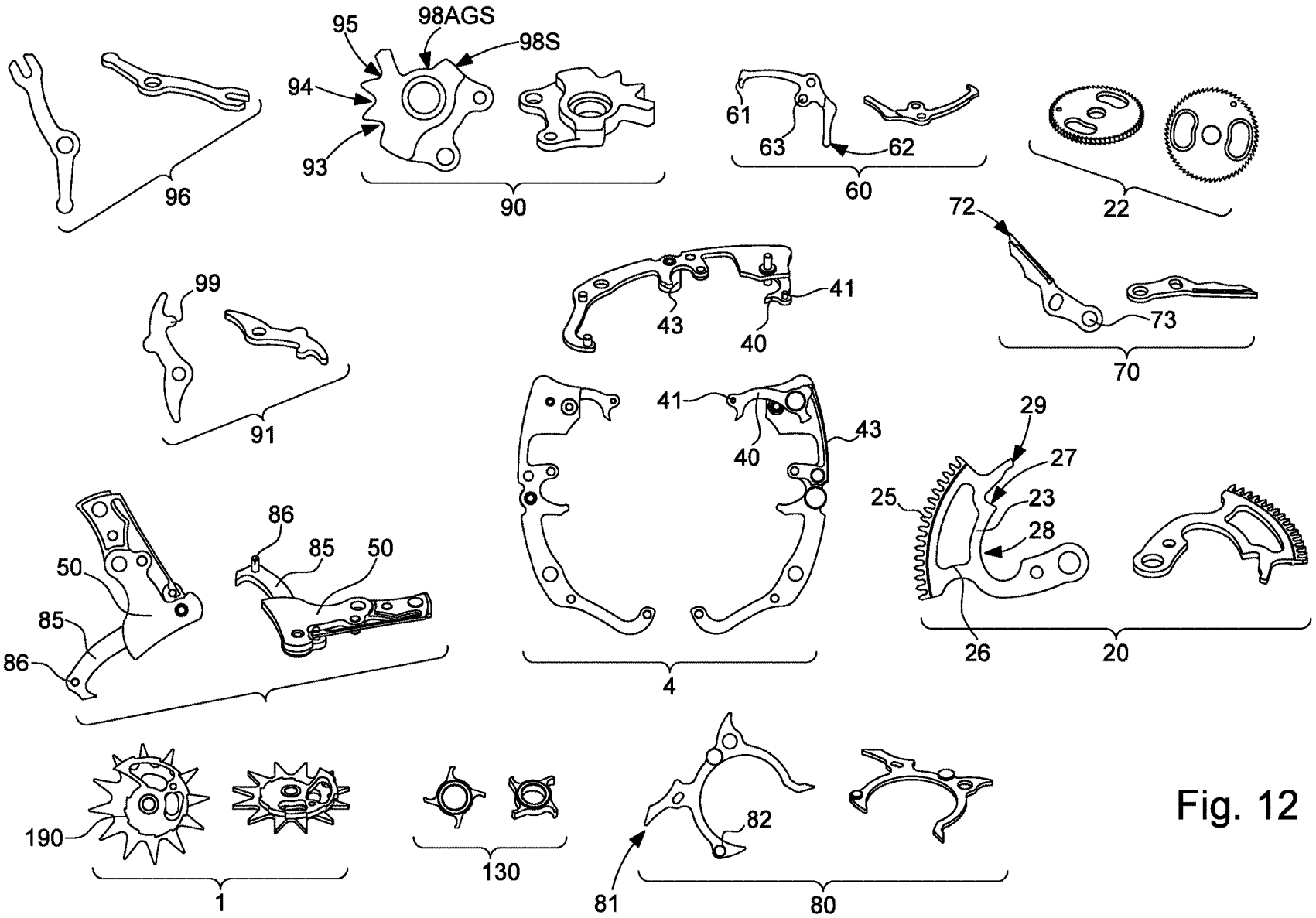
FIG. 12 is a schematic, plan view from both sides, of the panoply of main components of the striking mechanism according to the invention.
Figure 14:
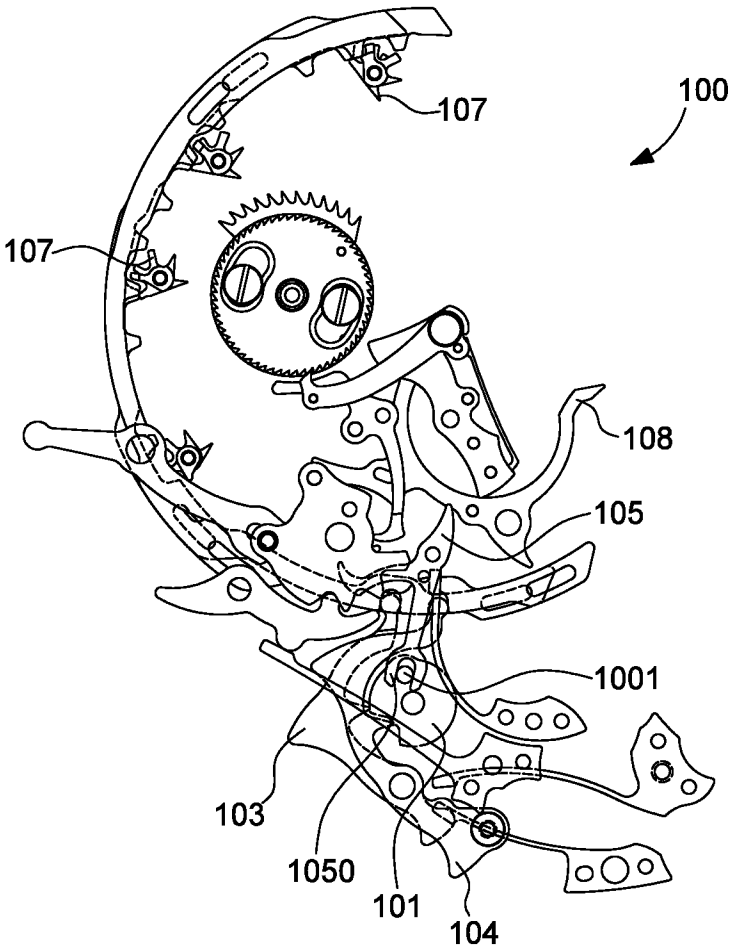
FIG. 14 is a block diagram which represents a watch comprising a striking mechanism according to the invention.
Figure 13:
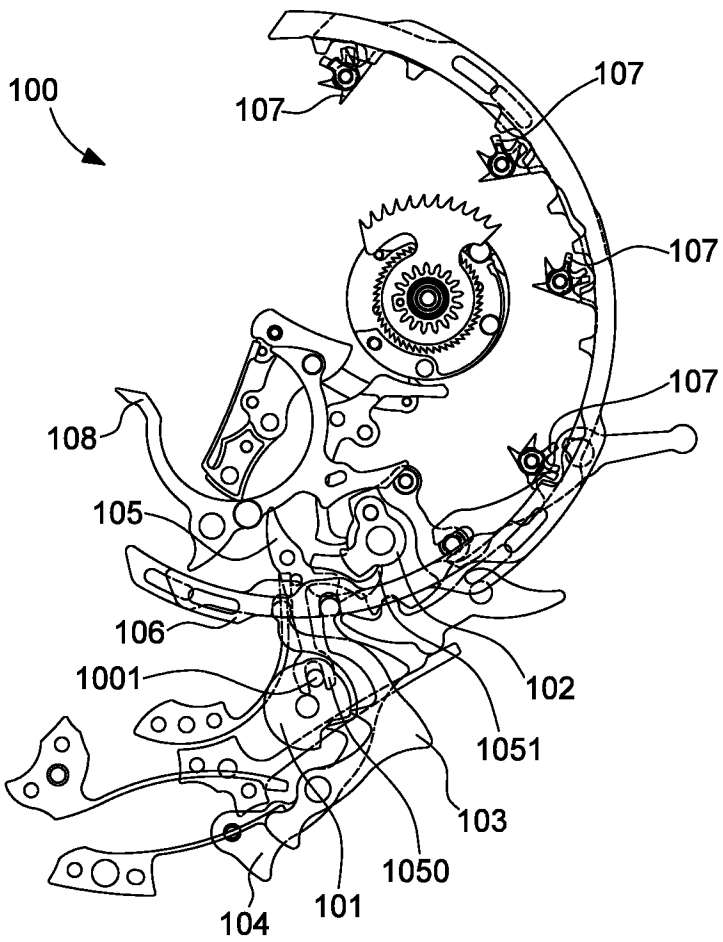
FIG. 13 is a block diagram which represents a watch comprising a striking mechanism according to the invention.
Figure 16:
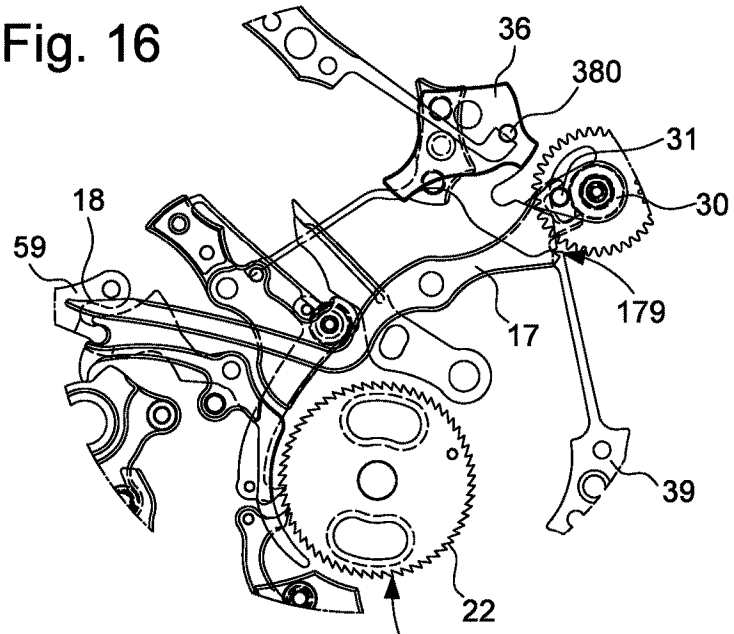
FIGS. 15 to 36 illustrate the kinematics of the stopping mechanism according to the invention, in different successive steps.
Figure 18:
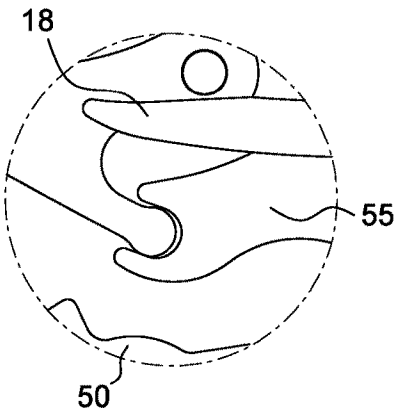
Figure 17:
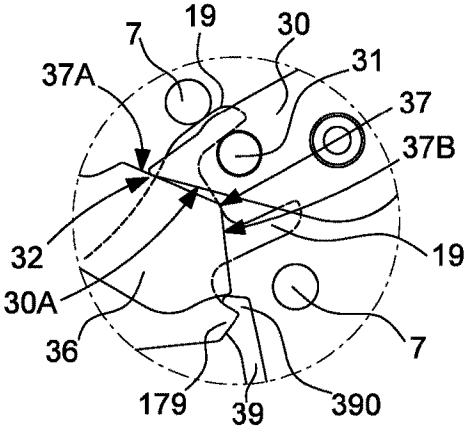

FIGS. 5 and 6 show the silent mode position, wherein the petite sonnerie and grande sonnerie mechanisms are uncoupled, but wherein it is possible to operate the minute repeater. Reading beak 61 of silencing lever 60 is resting on the largest radius 98S of a peripheral shoulder 98 of cam 90, and, consequently, on the one hand petite sonnerie lever 80 is stopped by cam pin 97 and spring 67 and, on the other hand, main arm 64 of silencing lever 60, seen in FIG. 11, is in its farthest position from strike drive wheel set 2, and stops main click pin 86. On the other hand, strike uncoupling lever 55 is very close to strike drive wheel set 2, since there is nothing to obstruct this end position, and consequently minute repeater release click 40 is not hindered and can access detent ratchet 22, and the minute repeater can thus be operated as desired by the user, When stopping mechanism 5 starts to operate, when the available energy is insufficient to ensure normal and complete performance of a striking function, and therefore a return of all the components to the rest position once the striking function has finished, the repeating-slide control lever 17 pivots abruptly, causing the pivoting of strike reversing lever 59 via its pin 16. Strike reversing lever 59 is articulated with strike uncoupling lever 55, which it immediately moves away from strike wheel set 2, to also move away main click 85 and minute repeater release click 40, thereby preventing the performance of any striking function.

When the user winds the barrel or barrels again, he operates stem 10: position T1 conventionally corresponds, in a first direction, to the winding of the barrel of the movement, and in the other direction, to the winding of the strike barrel, position T2 being reserved for setting the time of the watch.

When the user winds the barrel or barrels, it is only when the level of energy has become sufficient again that repeating-slide control lever 17 can make the reverse jump, thus driving strike reversing lever 59 and tipping strike uncoupling lever 55 to authorise the striking functions. The user must wind the barrel by a certain number of turns to ensure a minimum striking function. To this end, the winding train includes one or more barrels cooperating with at least one ratchet and a differential mechanism, particularly including a friction spring, and, whose setting defines the predefined threshold at which the stopping mechanism is released, or release in the other direction. The tipping of the uncoupling lever occurs instantaneously.

When the user sets the time of the watch, the movement of stem 10 into position T2 causes pull-out piece 11 to pivot, uncouples uncoupling lever 12, thereby driving strike reversing lever 59 and tipping strike uncoupling lever 55. The latter includes stop arm 56 which uncouples repeater click 41 and main strike click 85. This mechanism thus allows the user to set the time in both directions in complete security, since it is not possible to release the striking mechanism at that time.

The combination of this mechanism with the stopping mechanism constitutes an advantageous improvement for operating the watch safely in all circumstances.

Figure 8:
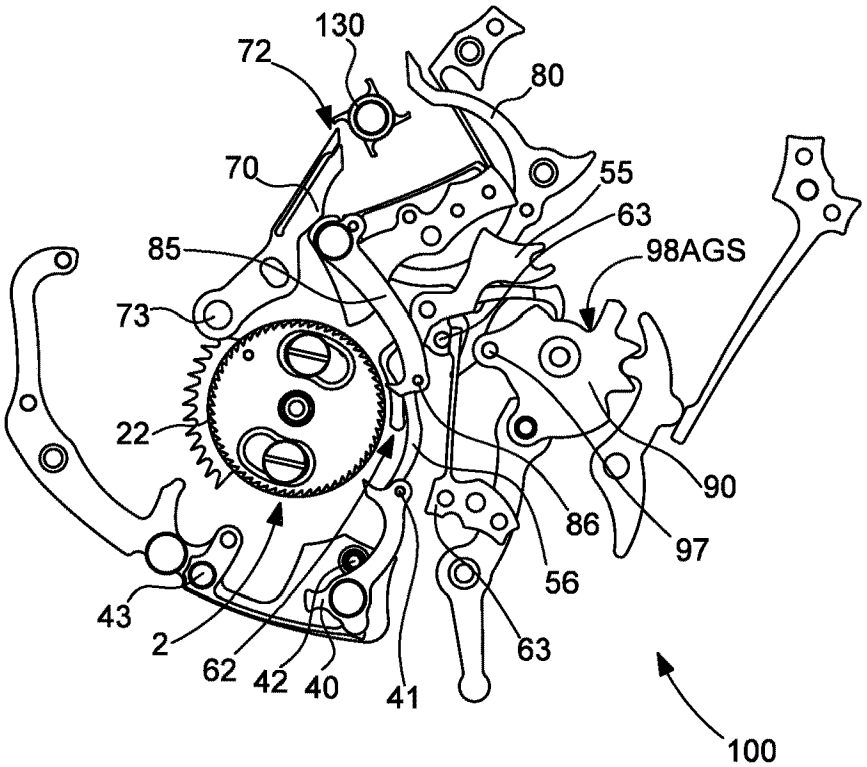
Figure 7:
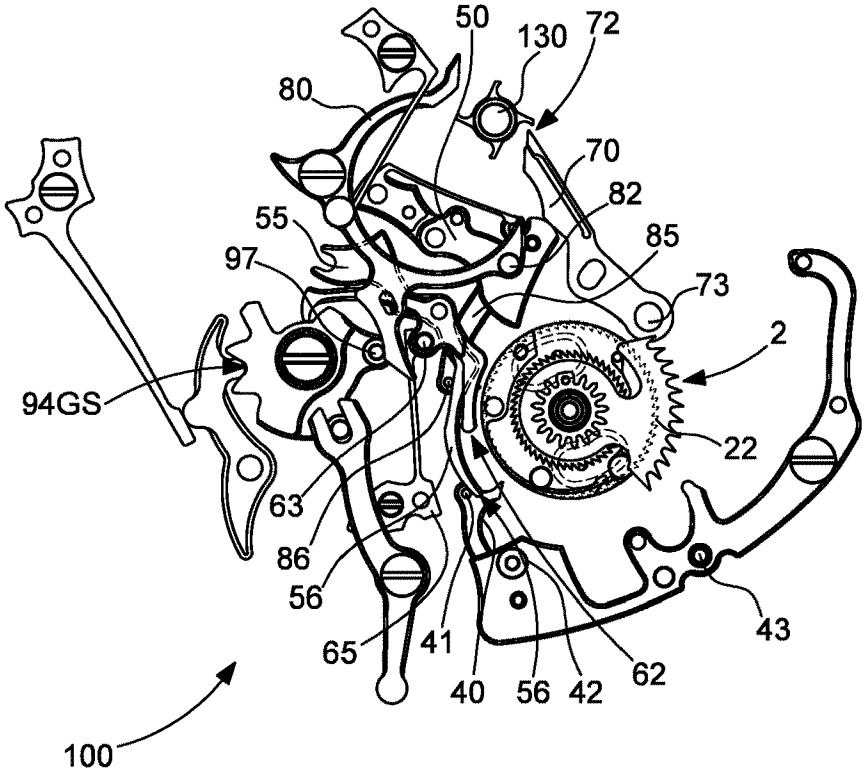

The stopping mechanism is coupled to the mechanism for uncoupling the clicks in position T2. These safety mechanisms use the same components for uncoupling the clicks, strike reversing lever 59 and strike uncoupling lever 55, but these mechanisms operate independently of each other. FIGS. 7 and 8 illustrate the stopping mechanism in grande sonnerie mode. Stopping mechanism 5 is arranged to uncouple all the clicks, when the amount of available energy, in the barrel(s) or suchlike, is insufficient. This time, reading beak 61 of silencing lever 60 is resting on the smallest radius 98AGS of peripheral shoulder 98 of cam 90, and, at its second end 62, main arm 64 of silencing lever 60 is in its closest position to strike drive wheel set 2, and cannot stop main click pin 86. On the other hand, strike uncoupling lever 55 is in its furthest position from strike drive wheel set 2, and consequently hinders both main pin 86 of main click 85 and repeater click pin 41, thus main click 85 and minute repeater release click 40 are hindered and cannot access detent ratchet 22. The minute repeater cannot be activated by the user. No striking function can therefore be activated. There is nothing to prevent another mode selection operation.

Figure 10:
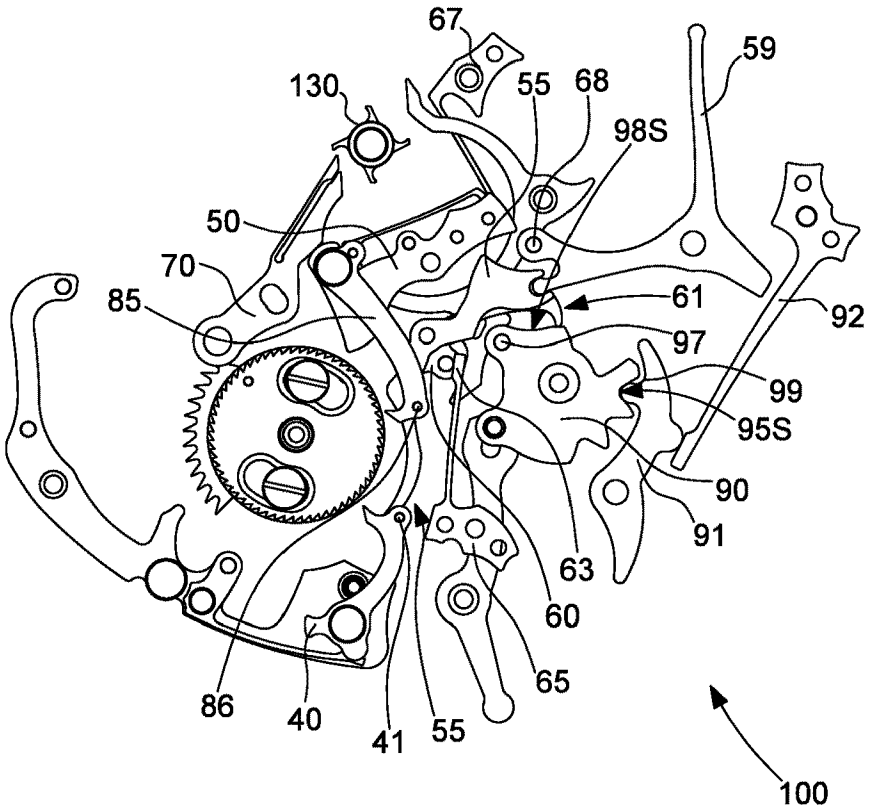
FIGS. 9 and 10 represent the striking mechanism according to the invention with stopping in silent mode.
Figure 9:
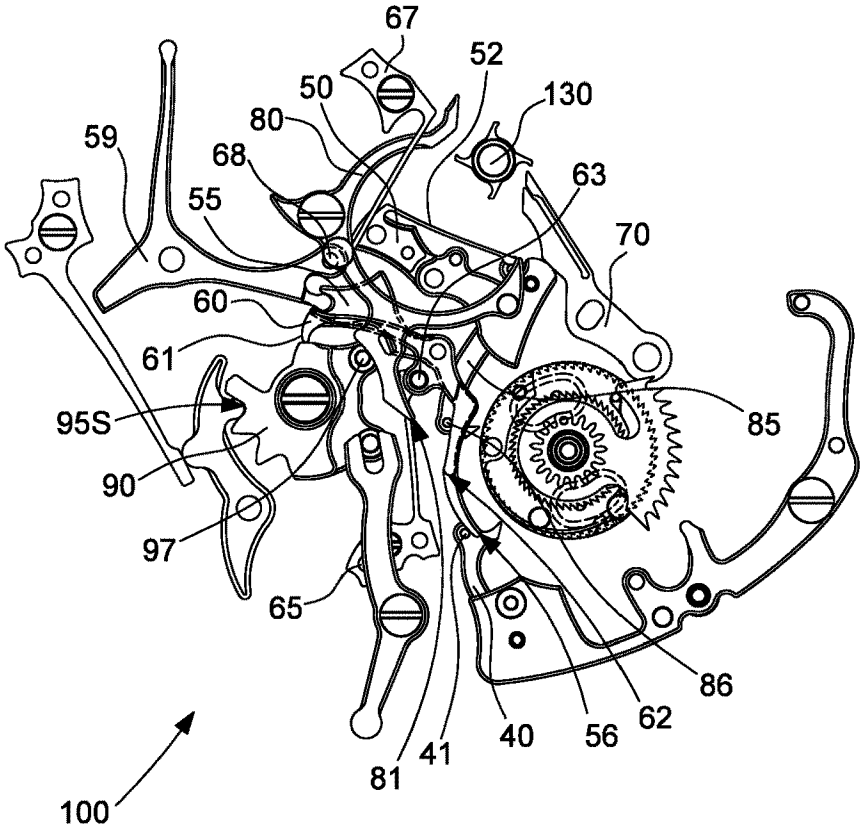

FIGS. 9 to 11 illustrate the stopping mechanism in silent mode. These Figures show strike reversing lever 59 for the articulated control of strike uncoupling lever 55. Reading beak 61 of silencing lever 60 is resting on the largest radius 98S of peripheral shoulder 98 of cam 90, and the main arm 64 of silencing lever 60 is in its furthest position from strike drive wheel set 2, and stops main click pin 86. Strike uncoupling lever 55 is also in its furthest position from strike drive wheel set 2, and hinders repeater click pin 41. Thus, main click 85 and minute repeater release click 40 are hindered and cannot access detent ratchet 22.

It is clear that the stopping mechanism is only active when there is not enough energy and that, otherwise, this stopping mechanism is disconnected.

The invention also concerns a watch 1000 comprising a movement 200 including an output 3 for releasing a passing strike by the movement, this movement 200 being arranged to drive at least one reference wheel set 1, and watch 1000 includes at least one such striking mechanism 100.

The invention also concerns a timepiece 2000 comprising a movement 200 including an output 3 for releasing a passing strike by the movement, this movement 200 being arranged to drive at least one reference wheel set 1, and watch 2000 includes at least one such striking mechanism 100.

What is claimed is:

1. A stopping mechanism for a striking mechanism for a watch or timepiece comprising a movement, said striking mechanism and/or said movement comprising energy storage means arranged to power said striking mechanism to perform the striking functions, at an output of said energy storage means which comprise a power reserve transmission wheel set, said striking mechanism comprising at least one strike drive wheel set comprising a detent ratchet and a repeating rack pinion, a main click for the passing strike function and/or a click for releasing a minute repeater when said striking mechanism includes a minute repeater, wherein said stopping mechanism includes a strike uncoupling lever arranged to move away from said strike wheel set said main click and said minute repeater click when said striking mechanism includes a minute repeater, by an instantaneous jump of a repeating-slide control lever arranged to cause a change of position of said strike uncoupling lever, as soon as the level of available energy in said storage means crosses a predefined threshold, by the cooperation between, on the one hand, a stop finger indirectly driven by said power reserve transmission wheel set and, on the other hand, a stop jumper returned by a first spring, to bring a stop pin integral with said stop finger to bear on a fork comprised in said repeating-slide control lever, to cause an abrupt pivoting of said repeating-slide control lever by the instantaneous change of position of a lug comprised in said repeating-slide control lever with respect to a second spring.

2. The stopping mechanism according to claim 1, wherein said stopping mechanism is arranged to pivot a strike reversing lever, arranged to control the pivoting of said strike uncoupling lever, which is arranged to prevent access by said repeater click to said detent ratchet when the available energy is insufficient to complete a striking function, and to move said main click away from said detent ratchet when the available energy is insufficient to complete a striking function.

3. The stopping mechanism according to claim 2, wherein said stopping mechanism includes said repeating-slide control lever, which includes, at a first end, said fork which is arranged to surround said stop pin, and, underneath said fork, said lug, which is arranged to cooperate with said second spring or with a jumper controlled by said second spring, which is arranged to give said repeating-slide control lever bistable behaviour, and said repeating-slide control lever includes, at a second opposite end, a control arm, and wherein said control arm is resting on a pin comprised in said strike reversing lever, which is in turn articulated, on a first side, with said strike uncoupling lever and which is articulated, on a second side, with an uncoupling lever, returned by an uncoupling spring, and arranged to cooperate with a pull-out piece cooperating with the winding and setting control stem.

4. The stopping mechanism according to claim 3, wherein said uncoupling lever carries an indicator intended to indicate to the operator whether or not the striking functions are available.

5. The stopping mechanism according to claim 1, wherein said stopping mechanism includes a stop wheel, coaxial to said stop finger, and arranged to mesh with said power reserve transmission wheel set, which stop wheel includes an oblong hole, and wherein said stop finger includes said stop pin, which is movable in a limited manner inside said oblong hole, and a tip which is arranged to follow an edge of said stop jumper.

6. The stopping mechanism according to claim 1, wherein said stopping mechanism includes said repeating-slide control lever, which includes, at a first end, said fork which is arranged to surround said stop pin, and, underneath said fork, said lug, which is arranged to cooperate with said second spring, or with a jumper controlled by said second spring, which is arranged to give said repeating-slide control lever bistable behaviour, and said repeating-slide control lever includes, at a second opposite end, a control arm.

7. The stopping mechanism according to claim 6, wherein said second spring forms a repeating-slide control jumper and is arranged to force said fork of said repeating-slide control lever to rest on a detent pin, or on a banking wall, in each of the two positions that said repeating-slide control lever can occupy.

8. A striking mechanism for a watch or timepiece comprising a movement, said striking mechanism and/or said movement comprising energy storage means arranged to power said striking mechanism for the striking functions, at an output comprising a power reserve transmission wheel set, said striking mechanism comprising at least one strike drive wheel set comprising a detent ratchet and a repeating rack pinion, a main click for the passing strike function and/or a click for releasing a minute repeater when said striking mechanism includes a minute repeater, wherein said striking mechanism includes a stopping mechanism according to claim 1.

9. A watch comprising a movement including an output for releasing a passing strike by the movement, said movement being arranged to drive at least one reference wheel set, and said watch including at least one said striking mechanism according to claim 8.

10. A timepiece comprising a movement including an output for releasing a passing strike by the movement, said movement being arranged to drive at least one reference wheel set, and said timepiece including at least one said striking mechanism according to claim 8.

* * * * *